US006202222B1

(12) United States Patent
Robbins

(10) Patent No.: US 6,202,222 B1
(45) Date of Patent: Mar. 20, 2001

(54) OSTOMY UNDERGARMENT

(76) Inventor: Cynthia Deans Robbins, 6125-B Heathstone La., Charlotte, NC (US) 28210

( * ) Notice: Subject to any disclaimer, the term of this patent is extended or adjusted under 35 U.S.C. 154(b) by 0 days.

(21) Appl. No.: 09/422,532

(22) Filed: Jan. 26, 1999

(51) Int. Cl.[7] ..... A41B 9/00

(52) U.S. Cl. ..... 2/406; 2/400; 2/69; 450/150

(58) Field of Search ..... 2/400–408, 227, 2/228, 238, 69, 70, 80, 83, 114, 73; 450/150, 155; 604/332, 345, 322, 356, 357, 393

(56) References Cited

U.S. PATENT DOCUMENTS

| | | | | |
|---|---|---|---|---|
| 2,583,721 | * | 1/1952 | Beede | 604/345 |
| 2,688,327 | * | 9/1954 | Berg | 604/332 |
| 2,691,375 | * | 10/1954 | Tasse | 604/332 |
| 2,778,362 | * | 1/1957 | Pollock et al. | 604/332 |
| 3,421,505 | * | 1/1969 | Freeman et al. | 604/345 |
| 3,468,310 | * | 9/1969 | Kimball | 604/332 |
| 3,844,282 | * | 10/1974 | King | 604/345 |
| 3,852,828 | | 12/1974 | Silverstein . | |
| 4,495,662 | * | 1/1985 | Miller | 604/332 |
| 4,498,200 | | 2/1985 | Livingstone . | |
| 4,533,355 | * | 8/1985 | Fair | 604/345 |
| 4,821,342 | | 4/1989 | Troyer . | |
| 4,888,006 | * | 12/1989 | Beaupied | 604/345 |
| 4,984,304 | | 1/1991 | Brown . | |
| 5,067,178 | | 11/1991 | Katchka . | |
| 5,093,935 | | 3/1992 | Countee, Jr. . | |
| 5,174,305 | * | 12/1992 | Childs | 604/332 |
| 5,285,531 | | 2/1994 | Nalbandian . | |
| 5,363,511 | | 11/1994 | Brewer . | |
| 5,392,467 | | 2/1995 | Moretz . | |

* cited by examiner

*Primary Examiner*—Gloria M. Hale

(57) ABSTRACT

A garment for individuals wearing an ostomy appliance comprises an undergarment having front, back and crotch panels, waist and leg bands stitched together to construct a typical panty or undergarment. The garment incorporates an inner, "hidden" pocket which surrounds and supports the connected flange of an appliance and contains the appliance pouch in the inner pocket apart from the user's abdominal skin.

9 Claims, 2 Drawing Sheets

OSTOMY UNDERGARMENT

FIELD OF THE INVENTION

The present invention relates to ostomy undergarments for accommodating an ostomy appliance worn by patients having undergone an ileostomy, colostomy, or the like.

BACKGROUND OF THE INVENTION

Individuals can undergo a variety of surgical procedures, where portions of the intestinal and/or urinary tract are removed, the remaining portions are brought to the abdominal wall and a new outside opening or stoma is surgically created through which urine or feces will pass. The location and size of the stoma varies from individual to individual as a result of the surgical procedure followed. For example, the location of the stoma created during a colostomy can vary according to the portion of the colon which is diseased.

The increasing ability of medical science to diagnose and successfully remove internal tumors or correct abnormalities has rapidly increased the number of individuals functioning in society today and while wearing an ostomy appliance. After surgery, such individuals typically rely on the use of an ostomy appliance for the collection and disposal of urine and/or feces discharged through the stoma. Due to the individual characteristics of the surgical procedures and the created stomas, ostomy appliances vary to meet the differing needs of the user. A wide variety of appliances for the collection of waste products exiting the body through the stoma are presently commercially available. Typically, ostomy appliances are one or two interlocking pieces which adhere to the user's abdomen, encircling the stoma. While providing for the sanitary reception of the material discharged through the stoma, some appliances further allow for drainage of fluid without the complete removal of the appliance.

Individuals having been fitted with an ostomy appliance have typically depended upon an encircling belt or support type garment in the proximate region of the body for support of the appliance. Generally, however, these prior ostomy undergarments have failed to provide sufficient support necessary for the comfort of the user or have the result that the pouch rests against the skin of the wearer. Often maintenance of the appliance by the user is difficult and awkward when worn with prior garments. The user often experiences skin irritation from the pouch resting directly against the skin. With prior garments, the appliance was readily noticeable under the user's clothing. Further, prior garments and containment articles made either no provision or insufficient accommodations for night, active (ie. exercise or spa activities) and intimate wear by the user. Numerous insufficiencies of prior garments or articles have negatively affected or neglected both the physical and psychological comforts and needs of the user.

Prior art and patents propose various undergarments but none provide all the benefits proposed in this invention and all heretofore known suffer from a number of disadvantages. Several types of undergarments have been proposed—for example, patents by Silverstein (U.S. Pat. No. 3,852,828), Brown (U.S. Pat. No. 4,984,304), and Brewer (U.S. Pat. No. 5,363,511) show only a basic undergarment. Patents by Livingston (U.S. Pat. No. 4,498,200), Katchka (U.S. Pat. No. 5,067,178), Countee (U.S. Pat. No. 5,093,935), Nalbandian (U.S. Pat. No. 5,285,531), and Moretz (U.S. Pat. No. 5,392,467) show an undergarment with some variation of a basic storage/concealed pocket not functional for ostomates. The patent by Troyer (U.S. Pat. No. 4,821,342) is a panty with waterproof material for incontinent persons which does not provide any advantages to ostomates. Patents by Fair (U.S. Pat. No. 4,533,355) and Beaupied (U.S. Pat. No. 4,888,006) are undergarments specific to individuals with an ostomy but are limited to concealment only. Pending application by Gupton (1998) is an ostomy undergarment designed for males or persons requiring special assistance in getting dressed or a caregiver and is limited to concealment and access only.

After careful review of prior art garments noted above, it is apparent that although they include some type of basic storage/concealed pocket, they do not address specific advantages of appropriate positioning of the pocket which is a major consideration for ostomates, or are not designed to properly accommodate the ostomy appliance pouch.

By caring for the physical and psychological needs of support, containment, comfort, and discretion, the resulting effect on the user is one of improved confidence and self-esteem.

SUMMARY OF THE INVENTION

Among the objects and advantages of the present invention are:

(a) to provide a specialty undergarment which appears like a normal panty, (b) to provide an undergarment designed to meet special needs of the ostomate for the containment of an ostomy appliance pouch which does not add bulk or inches to the abdominal area, (c) to provide an affordable, easily laundered, comfortable, specialty undergarment, (d) to provide a garment containing a hidden pocket to conceal an ostomy while providing a comfortable barrier between pouch and user's abdomen, (e) to provide support to ostomy appliance flange where unique bound opening of inner lining/hidden pocket surrounds flange, (f) to provide an ostomy panty which accommodates either left or right side ostomy appliance, (g) to provide a panty with a unique pouch-containing pocket having a recloseable opening at one of the panty's leg openings which allows discreet emptying of pouch contents without removing panty.

Further objects and advantages of my invention will become apparent from consideration of the drawings and ensuing description.

BRIEF DESCRIPTION OF THE DRAWINGS

In the drawings, closely related figures have the same number but different alphabetic suffixes.

DETAILED DESCRIPTION OF THE PREFERRED EMBODIMENT

This invention relates to a new ostomy garment for individuals having a surgical stoma and an ostomy appliance irrespective of size or location or activities of the user. The garment includes a comfortable, lightweight, absorbent, hidden, fabric pocket which surrounds and supports the connected flange of an appliance and contains the appliance pouch in the inner pocket apart from the user's abdominal skin. This garment not only provides a barrier between the ostomy appliance and the user's abdominal skin thus reducing irritation but allows the appliance to loosely move through the passageway into the inner pocket. The passageway and pocket can flex and enlarge to accommodate the torso of the individual and collection of body wastes in the appliance pouch without undue restriction. The unique design of the garment is particularly attractive to new ostomates recovering from surgery and adjusting to the collection of waste products outside the body as well as sensitivity of the surgical site. It is also quite desirable to ostomates concerned with minimizing added "bulk" in the abdominal area. The garment of this invention provides support and comfort but is constructed so that the appliance is not in plain view but concealed from others in a dressing or locker room environment.

More specifically and unique to this garment, by means of a convenient, comfortable hook and loop fasteners the pocket has a recloseable opening at one leg opening of the panty, the present invention allows the user the means through which the appliance pouch can be discreetly emptied without removing the panty. This feature was not available in any prior art. Also unique to this invention, the inner pocket extends approximately 1 inch to 2 inches into the crotch area in order for the user to locate the removable clip closure of the ostomy appliance to the most comfortable area possible.

Further features and advantages of the invention can become more readily apparent from the following detailed description of specific embodiments of this invention when taken in conjunction with the accommodating drawings.

While this invention is susceptible of embodiment in several forms, there is shown in the figures and will herein be described in detail a preferred embodiment of the invention with the understanding that present disclosure is to be considered as an explanation of the principals of the invention.

Figure 4:
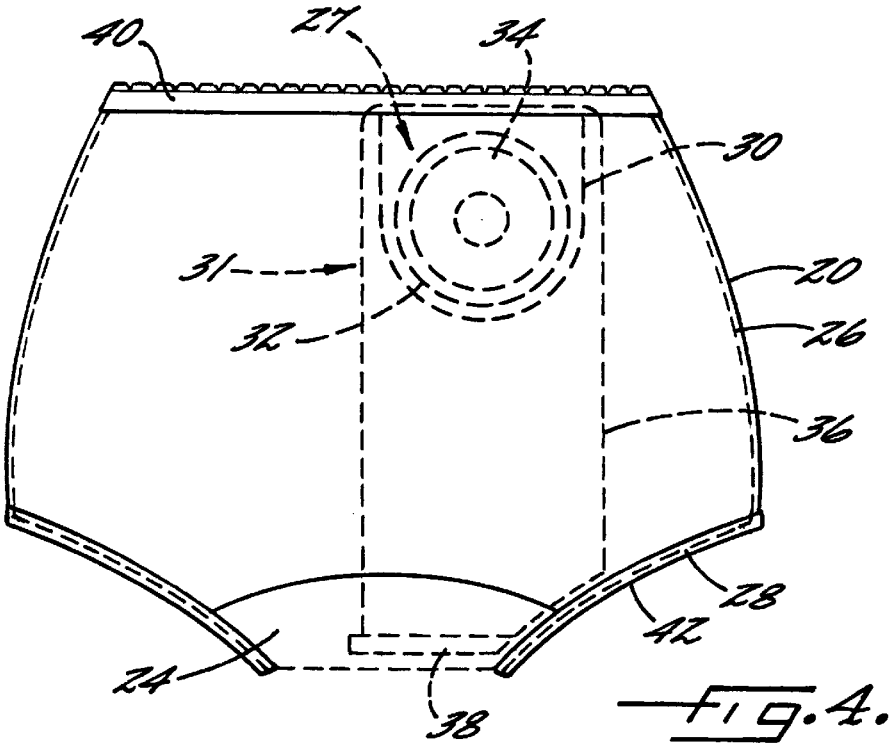
FIG. 4 is a front elevation view of the ostomy garment showing inside detail of front panel lining/hidden pocket operational with ostomy appliance flange/pouch and recloseable leg opening as worn by female user.

Referring first to FIG. 4, the ostomy appliance (31) is comprised of a wafer (32) having a circular disk or flange (34) which attaches to the stoma on the user's body. The ostomy flange (34) comes in several different sizes/circumferences. Said ostomy appliance flange (34) also has as part of its structure a pouch (36) for the collection of body wastes exiting the body through the stoma. Most, but not all, types of ostomy pouches (36) have an opening at the bottom through which body wastes can be emptied which is also secured by a removable pouch clip closure (38).

Figure 1A:
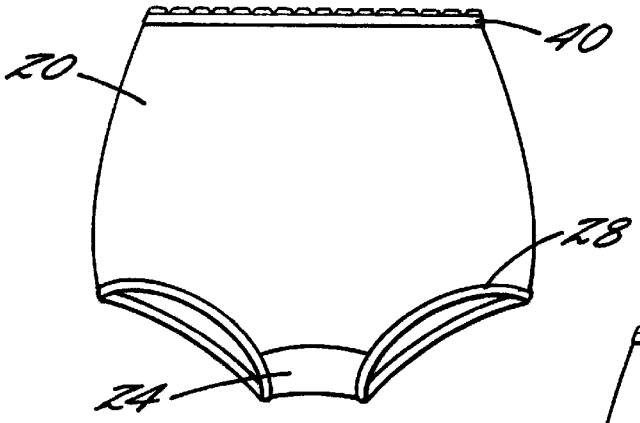
FIG. 1A is a front elevation view of the garment.
Figure 1B:
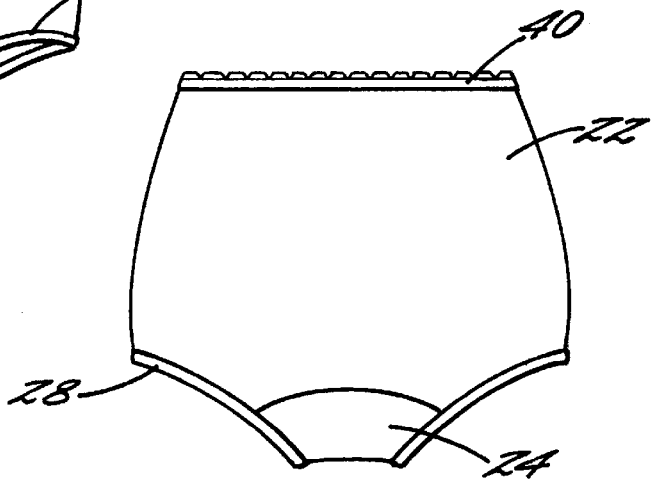
FIG. 1B is a back elevation view of the garment shown in FIG. 1A.

Basic construction of the ostomy garment as shown in FIGS. 1A and 1B includes a front panel (20), back panel (22), crotch panel (24) and a waistband (40) stitched together to construct a typical panty or undergarment. As shown in FIGS. 1 through 4, the ostomy garment has leg bands (28) which include light elastic which hugs the wearer's legs like a typical panty.

Figure 2:
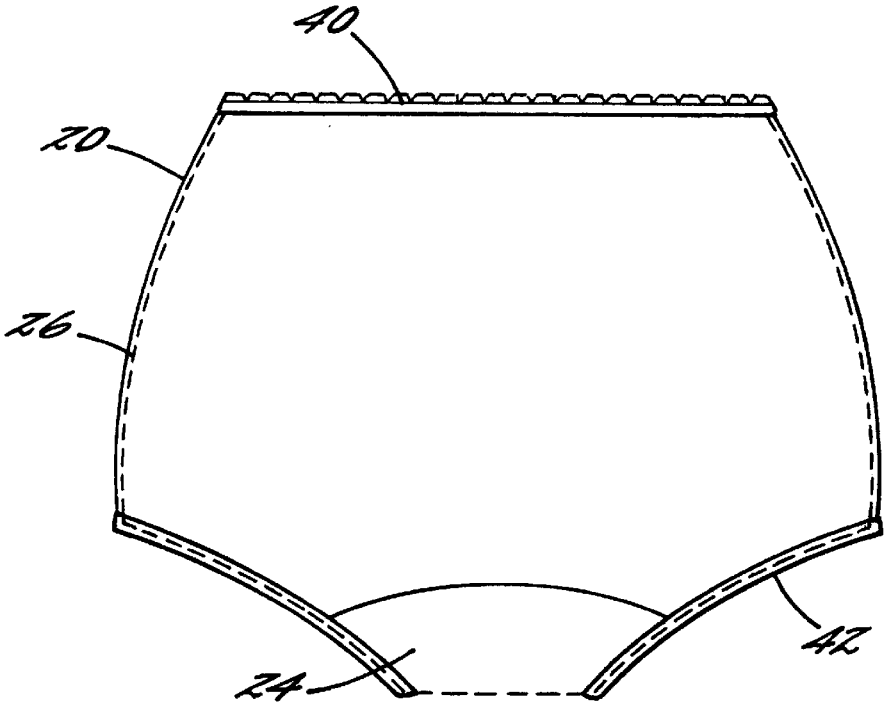
FIG. 2 is a front elevation view of the garment shown in FIG. 1A, partly broken away showing front panel lining/hidden pocket.
Figure 3:
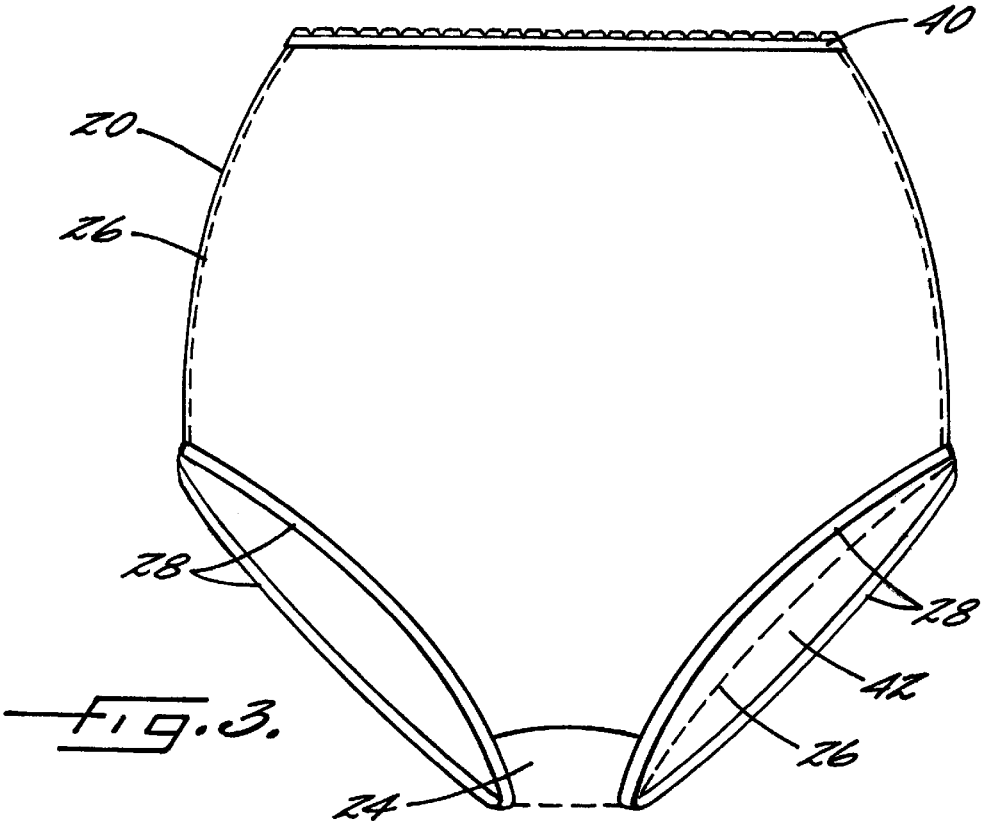
FIG. 3 is a front elevation view of the garment shown in FIG. 2 with cross-sectional view of the front panel lining/hidden pocket with recloseable leg opening.

As shown in FIGS. 2 through 4, the front panel (20) is faced with a lightweight fabric lining (26) such that a hidden pocket (27) is defined between the fabric lining (26) and the front panel (20). Said fabric lining/hidden pocket (26) is stitched into the side seams between the front panel (20) and back panel (22) of the garment, to the waistband (40) and to the crotch panel (24). The fabric lining (26) is interposed between front panel (20) of the ostomy garment and the abdomen of the user.

As shown in FIG. 4, the hidden pocket (27) includes a bound pocket opening (30) just below the waistband (40) that surrounds and supports the ostomy flange (34) which connects to the stoma on the user's abdomen and allows the pouch (36) of the appliance to be inserted into the pocket (27). Ostomy appliance pouch (36) with removable pouch clip closure (38) comfortably extends down between the fabric lining (26) and the front panel (20). The fabric lining (26) provides a comfortable, pliable fabric barrier between the ostomy appliance pouch (36) and user's abdomen. The hidden pocket (27) is wide and thus accommodates a stoma on either side of body and includes a unique recloseable leg opening (42) which opens and closes by means of a hook and loop closure and is located in the leg band (28) on the same side of the body as the stoma. Said recloseable leg opening (42) allows user to empty waste contents of ostomy pouch (36) conveniently without removing the panty.

The recloseable leg opening (42) when closed contains appliance pouch (36) out of sight within lining/hidden pocket (27) of panty underneath individual's clothing. As shown in FIG. 4, the lining/hidden pocket (27) extends approximately 1" to 2" (depending on the user's needs) into the crotch panel (24) in order to allow for convenient, comfortable positioning of the removable ostomy pouch clip closure (38).

Accordingly, the reader will see that the ostomy undergarment of this invention certainly provides the ostomate a unique garment specific to their special needs. The invention described provides features not found in prior art. Since comfort and self-esteem are major considerations for the ostomate, this undergarment is designed to not add bulk or inches to the abdominal area but provides a unique, lightweight, front panel lining/hidden pocket which conceals ostomy. The undergarment's unique hidden pocket provides a comfortable, lightweight, fabric barrier between the ostomy pouch/appliance and user's abdomen and is not found in any prior art/product. In addition, this garment has another unique feature not found in prior art which is a recloseable leg opening that allows the ostomate to empty the contents of the pouch without removing the entire panty. Hidden pocket/front panel lining of the undergarment also provides support to the ostomy appliance where a bound opening surrounds the flange. This specialty undergarment is affordable, normal in appearance, easily laundered, and offers unique features for the ostomate not previously available.

I claim:

1. An ostomy garment for accommodating an ostomy appliance having a flange for engaging a surgical stoma of a wearer and having a pouch attached to the flange, the pouch having a recloseable bottom opening for emptying the pouch, the garment comprising:

a front panel and a back panel joined together so as to form a structure for encircling a lower torso of the wearer, and a crotch panel joined to the front and back panels so as to form a crotch portion and so as to define two leg openings for the garment; and a fabric lining joined to the front panel and disposed adjacent an inner surface thereof so as to form a pocket for containing the pouch, the pocket having an upper opening for insertion of the pouch therethrough into the pocket, the pocket further including a recloseable opening adjacent one of the leg openings of the garment for allowing the pouch to be emptied via the bottom opening of the pouch.

2. The ostomy garment of claim 1, wherein the upper opening of the pocket for insertion of the pouch thereinto is structured and arranged to engage and support the flange of the appliance.

3. The ostomy garment of claim 2, wherein the upper opening is generally U-shaped.

4. The ostomy garment of claim 1, wherein the garment includes side seams between opposite side edges of the front and back panels, and wherein the fabric lining is stitched into the side scams.

5. The ostomy garment of claim 1, wherein an upper edge of the fabric lining is stitched to a waistband of the garment.

6. The ostomy garment of claim 1, wherein the pocket is substantially as wide as the front panel so as to accommodate the appliance in various positions relative to the wearer's body.

7. The ostomy garment of claim 1, wherein the pocket is defined between the front panel and the fabric lining.

8. The ostomy garment of claim 1, wherein a bottom of the pocket extends downwardly about 1 to 2 inches into the crotch portion of the garment.

9. An ostomy garment for accommodating an ostomy appliance having a flange for engaging a surgical stoma of a wearer and having a pouch attached to the flange, the garment comprising:

a front panel and a back panel joined together so as to form a structure for encircling a lower torso of the wearer, and a crotch panel joined to the front and back panels so as to form a crotch portion and so as to define two leg openings for the garment; and a fabric lining joined to the front panel and disposed adjacent an inner surface thereof so as to form a pocket for containing the pouch, the pocket having an upper opening for insertion of the pouch therethrough into the pocket, the upper opening being generally U-shaped for supporting the flange of the ostomy appliance, and the pocket being substantially as wide as the front panel so as to accommodate the appliance in various positions relative to the wearer's body.

* * * * *